US007100632B2

(12) United States Patent
Harwood

(10) Patent No.: US 7,100,632 B2
(45) Date of Patent: Sep. 5, 2006

(54) SUMP LINER

(76) Inventor: Alden Harwood, 74 Harding Ave., Kenmore, NY (US) 14217

( * ) Notice: Subject to any disclaimer, the term of this patent is extended or adjusted under 35 U.S.C. 154(b) by 214 days.

(21) Appl. No.: 10/703,767

(22) Filed: Nov. 7, 2003

(65) Prior Publication Data

US 2004/0094209 A1 May 20, 2004

Related U.S. Application Data

(63) Continuation-in-part of application No. 10/227,701, filed on Aug. 26, 2002, now Pat. No. 6,854,479.

(51) Int. Cl.
*F04B 41/06* (2006.01)
*F04B 49/025* (2006.01)

(52) U.S. Cl. ..... 137/362; 137/558; 137/565.33; 417/5; 417/40

(58) Field of Classification Search ..... 137/362, 137/558, 565.29, 565.33, 565.37; 417/3, 417/4, 5, 40, 63; 52/169.4; 220/4.21, 4.24, 220/4.26
See application file for complete search history.

(56) References Cited

U.S. PATENT DOCUMENTS 1,059,409 A * 4/1913 Thomas ..... 417/40
1,328,262 A * 1/1920 Boosey ..... 137/362
2,222,595 A * 11/1940 Regester ..... 417/5
3,020,922 A * 2/1962 Oury ..... 137/362
3,112,760 A * 12/1963 Budd ..... 137/565.33
3,233,549 A * 2/1966 Howe ..... 417/28
3,726,606 A 4/1973 Peters
3,814,544 A 6/1974 Roberts et al.
3,972,647 A * 8/1976 Niedermeyer ..... 417/2
4,215,975 A 8/1980 Niedermeyer
4,437,811 A * 3/1984 Iwata et al. ..... 417/40
4,456,432 A 6/1984 Mannino
4,541,446 A * 9/1985 Hogan ..... 137/2
4,631,001 A 12/1986 Keech
4,949,626 A * 8/1990 Townsend et al. ..... 52/169.5
5,314,313 A 5/1994 Janesky
5,836,815 A * 11/1998 Jennemann ..... 52/169.5

(Continued)

*Primary Examiner*—John Rivell
(74) *Attorney, Agent, or Firm*—Hodgson Russ LLP

(57) ABSTRACT

A sump liner comprising a liner wall joined with a base member, the liner wall extending about the periphery of the base member, the liner wall comprising a primary reservoir portion and a secondary reservoir portion, with a weir extending from the base member and the inside surface of the liner wall. The weir divides the sump liner interior into a primary reservoir and a secondary reservoir, with a primary pump to remove water from the primary reservoir and a secondary pump to remove water from the secondary reservoir. The primary reservoir receives drainage water through an inlet pipe. The secondary reservoir receives drainage water that flows over the weir in the event the primary pump in the primary reservoir fails, in which case the secondary pump in the secondary reservoir pumps out the water. The weir may have an inverted V-shape. A sump liner and with a vented lid bolted to it to form an airtight seal. The vented lid comprising a body defining a vent opening, electric cable openings, and a drain pipe opening. A drain connects to the vented lid and a drain pipe extends from the drain and into the sump liner, the drain pipe having a submersed end for being submerged in water in the sump liner and for forming a seal with water in the sump liner so that gas from inside the sump liner cannot exit the sump liner through the drain.

12 Claims, 10 Drawing Sheets

U.S. PATENT DOCUMENTS 6,308,924 B1 10/2001 Janesky 6,854,479 B1 * 2/2005 Harwood ..... 137/362

* cited by examiner

SUMP LINER

CLAIM OF BENEFIT OF PRIOR FILED APPLICATION

This application is a continuation-in-part of application Ser. No. 10/227,701, filed Aug. 26, 2002 now U.S. Pat. No. 6,854,479.

BACKGROUND

Groundwater has been and continues to be a significant problem for buildings, especially for buildings with basements and crawl spaces. The floor of a basement typically comprises a several-inch-thick slab of concrete, poured upon a layer of crushed stone. If the surrounding water table stays below the crushed stone layer there may not be water problems in the basement. However, when the groundwater rises above the crushed stone it begins to adversely affect the building. The basement floor and basement walls become damp and/or leak. This is very undesirable. The past and present solutions to this problem are to simply collect and remove enough groundwater to keep hydraulic forces at an acceptable level. Typically, a sump located at the lowest point in a building's foundation drainage system, and a pump employed to evacuate the sump, discharging the water far enough from the building to be of no further concern.

Usually the sump is excavated at the time of the building's construction. The sump is basically a reservoir into which a cylindrical liner is placed; the liner is closed at the bottom and open at the top, and is typically constructed of polyethylene or other plastic resins. The liner defines ports along its cylindrical sidewall through which groundwater flows and collects in the reservoir. The sump liner is installed such that its open end will be flush with the adjacent finished floor. Sumps excavated subsequent to construction of the floor require removal of a sufficient amount of the floor along and underlying material to receive the liner. Then, concrete is poured around the sump liner to seal it in.

Most sump liners have inlet ports and/or are perforated for receiving drainage water from about the building's foundation footing tile drainage system through it and from groundwater beneath the basement floor. Drainage water then collects in the liner. When sufficient water has thus accumulated, a pump installed in the sump, commonly called a sump pump, is actuated and evacuates most of the water in the sump into a sewer or to a location outside the building.

Sump pumps are electromechanical in nature and consist of an impeller driven by an electric motor, all of which is contained within a housing. A float switch that closes when the water level rises to a point in the sump that would justify the energy expenditure to remove it controls operation of the pump. These switches are either separate from or integrated with the pump. The switch opens and pumping stops before the water in the sump reaches the level at which the pump can no longer function due to ingestion of air at the pump's intake. Therefore, in normal cycle duty of the sump-pumping system the pump is always at least partially immersed in water. The discharge water from the pump enters a drainage pipe or hose that leads to a location outside the building such as a field, lawn, or storm sewer.

However, as many homeowners have learned to their chagrin, sump pumps are not infallible. When a sump pump fails the first event that occurs is the sump liner overfills and floods the basement floor. The water level in the basement continues to rise until equilibrium is established, meaning the water level in the basement rises until it equals the level of the surrounding water table. This results in numerous problems for the building owner including: severe flooding inside the building, damaged or destroyed property, disagreeable odors that permeate the building, structural damage to the building, and temporary loss of use of the basement. Then, even after the basement is pumped dry, longer-lasting problems may take root including: shifting of the building's foundation, malodorous problems throughout the building, and the unhealthful growth of molds, mildews, and bacteria in the basement. All of these longer-lasting problems result in increased expense to make the building and basement habitable again and may result in decreased property value.

That every sump pump manufactured to date will fail is a statistical certainty, and therefore no pump can be depended on to function as originally designed for and unlimited amount of time. The reasons for eventual pump failure are manyfold, and include at least the following: wear from friction; corrosion and electrolytic action caused by being immersed in contaminated water for its entire life, wreaking havoc on metallic surfaces; failure of seals and O-rings which results in the admission of water to components that must remain dry; accumulations of silt and other debris in the sump that can clog the pump intake, resulting in its inability to pump at the required rate, if it can pump at all; and obstructions in the discharge pipe that will disable a sump pump. Additionally, manufacturer defect in design or assembly must be recognized as a cause of pump failure.

Attempts to solve the problems associated with sump pump failure include use of a backup pump. However, the present use of backup sump pumps is not without problems. A sump liner provides for a relatively small diameter hole/opening, and to place a second pump internal to the sump is a difficult task. Additionally, complicated structural arrangements are called for when a backup sump pump is provided for in a sump liner, which necessitates use of a plurality of parts, some of which are small and intricate. There is also the high risk that separate floats for the separate pumps will become entangled, disabling both pumps. These parts must then be regularly maintained and examined since they can quickly deteriorate and become nonfunctional. Another way in which a backup pump has been used is to position a backup utility pump on the basement floor adjacent to the sump, instead of placing it within the sump liner. This also is not a satisfactory solution because not only does this arrangement present major problems in providing a reliable way to operate the pump when needed, but the backup pump is exposed to all the activities being carried out in the basement, such as people working in the basement, curious children exploring/playing in the basement, pets, and so forth. There is a high probability that one or more of these factors will conspire to render the backup pump inoperative without the knowledge of the building owner. If this happens, the backup sump pump will be of no use if the primary sump pump fails. In addition, such an exposed backup pump is constantly visible and is therefore aesthetically unappealing.

Additionally, there exists another problem related to basements which has recently received much attention. This problem is related to the seepage of radon gas into homes through sump holes, and through cracks and openings in basement walls and floors. Radon gas is radioactive and occurs naturally in the earth. However long term exposure to radon gas may result in cancers of the lung and throat. Nevertheless buildings/houses need sump pumps to remove excess water. If the sump pump is sealed in the sump to prevent the escape of radon into the house, then there is no means to rid the house of excess water in the event of a water pipe bursting or a the sewer backing up. This is because the water never enters the sump because of the seal. Thus, the unavailability of a discharge path for this water exacerbates the situation. There is a thus a need to overcome these problems.

Hence, there is a need for a better sump liner, methodology, and system for preventing flooded basements and the damage associated therewith that is reliable and easy to use, yet overcomes the numerous problems and shortcomings associated with the above-described sump pump arrangements. There is also a need for a way in which to reduce radon gas build up in basements and sump basins.

SUMMARY

The present sump liner advantageously defines a primary reservoir into which a primary sump pump is positioned and a secondary reservoir into which a secondary sump pump is positioned, with a weir separating the primary and secondary reservoirs. Under normal conditions, drainage water enters only the primary reservoir and is pumped out of the sump liner by the primary pump, while in the dry secondary reservoir the secondary pump remains in a brand-new "out of the box" condition. When the primary pump fails, the water will rise to the top of and flow over the weir into the secondary reservoir where the secondary sump will be activated by the high water levels acting upon its float switch, and it will pump the water out of the sump liner. This sump liner thus allows for superior and reliable removal of drainage water.

The sump liner comprises a base member, a liner wall comprising a proximal end and a distal end, with the proximal end joined with the base member. The liner wall extends about the periphery of the base member with the liner wall and the base member defining a sump liner interior therein. The liner wall comprises an inside surface and an outside surface. The liner also comprises a primary reservoir portion and a secondary reservoir portion. The primary reservoir portion surrounds the primary reservoir and the secondary reservoir portion surrounds the secondary reservoir. The primary reservoir portion allows drainage water to pass therethrough. To accomplish this, the primary reservoir portion of the liner wall may define an inlet pipe(s) opening and/or perforations, while the secondary portion or the liner wall has no such openings and is impermeable.

A weir extends from the base member and from the inside surface of the liner wall, the weir dividing the sump liner interior into a primary reservoir and an adjacent secondary reservoir. The height of the weir is less than the height of the liner wall. The primary reservoir is thus bounded by the primary reservoir portion of the liner wall, the base member and the weir; and the secondary reservoir is thus bounded by the secondary reservoir portion of the liner wall, the base member, and the weir. Drainage water is discharged out of the primary sump by the pump housed therein during normal operation while the secondary reservoir remains dry.

When the primary sump pump fails the drainage water will rise and flow over the weir into the secondary reservoir where it is pumped out of the sump liner by the secondary sump pump. The secondary sump pump is always in a new, "out of the box" condition (or certainly can be depended on to be in an "as last used" condition) and serves as an extremely reliable backup. Other advantages of the sump liner are that it allows the secondary sump pump to be stowed in a safe and dry environment until called upon to pump. This allows for the facilitated inspection and maintenance of the secondary pump. A lid is provided to cover the sump liner and to direct any water on the surrounding basement floor into the primary reservoir, excluding its admission to the secondary reservoir.

The presence of the secondary sump in place, ready to operate when needed, and preserved in original condition provides the owner not only with a heightened sense of security, but relieves of him or her of the pressures of the emergency presented with the discovered failure of a solitary pump. Even in the event that the owner may have anticipated the failure of the sump pump and has a spare on hand, its installation during a flood is difficult and unpleasant. The present sump liner provides for continuous and uninterrupted operation of the groundwater-removal system. Backup or auxiliary sump pumps, when they are activated, often leave no evidence of that event, and the owner would be unaware that it had been called to duty unless he or she actually observed that event. If the building owner observes water in the secondary liner, then she or he knows the primary pump failed and/or could not adequately handle the volume of inflowing water. The building owner can then investigate the primary pumping system, and can repair and/or replace the primary pump if necessary, and in a non-emergency mode.

Additionally, a simple low cost water alarm is positionable in the secondary reservoir. The alarm sounds upon contact with water, and continues to sound until reset. This forces the building owner to investigate, and drain and dry the secondary reservoir. The secondary reservoir and associated secondary pump are in this manner always kept in good working order.

Additionally, a radon removing arrangement is provided. In particular a vented lid is placed over the sump liner, and bolted to the sump liner to form an airtight seal. The lid is formed to have discharge pipe openings for allowing discharge pipes to pass through the lid. Additionally, the lid is formed to have electrical cable openings that allow electrical cables to pass through the lid. A vent opening is also formed in the lid for allowing gas from inside the sump liner to pass therethrough, and into a pipe that leads to the exterior of the building/house/structure where the sump liner is located. The lid is also formed to have a floor drain opening that allows any water on the basement floor to pass flow though it and into the sump liner. In particular a drain is installed in the drain opening, and a pipe is attached to the drain and extends downwardly to the bottom of the sump liner. The end of the pipe in the sump liner is submersed in water in the basin, but the end of the pipe in the basin is also has openings below the water line. Because of this arrangement, water on the basement floor is allowed to flow into the sump and be subsequently pumped out of the sump. But, because the end of the drain pipe in the sump is always submerged in water, no gas in the sump is allowed to flow though the pipe and out the drain and into the basement. A water seal is thus provided in the sump, such that only gas, for example radon gas, may exit the sump though the vent.

DESCRIPTION

Figure 3:
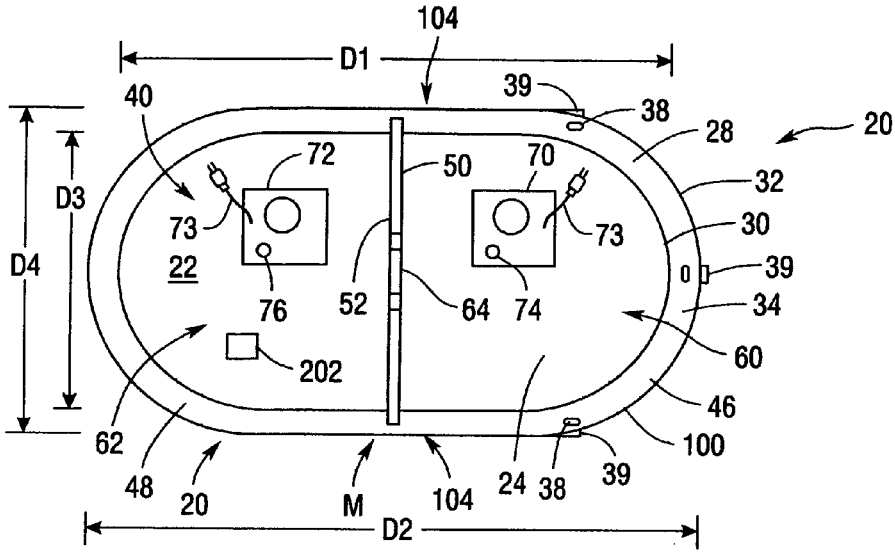
FIG. 3 is a top plan view of the sump liner.

The sump liner 20 collects drainage water from under a building's basement floor 200 (FIG. 1) and from about a building's foundation. The sump liner 20 comprises a liner wall 28 that extends about the perimeter of a base member 22. The liner wall 28 and base member 22 define a sump liner interior 40. The liner wall 28 comprises a primary reservoir portion 46 and a secondary reservoir portion 48. The sump liner 20 comprises a dam or weir 50 which is positioned in the sump liner interior 40 and divides the sump liner interior 40 into a primary reservoir 60 and a secondary reservoir 62 (FIG. 3). A primary sump pump 70 is provided for in the primary reservoir 60 and a secondary sump pump 72 is provided for in the secondary reservoir 62. These pumps 70, 72 receive electrical power through power cords 73. Drainage water (water) enters the primary reservoir 60 through one or more inlet pipes 39 extending though cutouts 38 defined or openings formed in the primary reservoir portion 46 liner wall 28. In other embodiments the cutouts 38 or openings formed in the primary reservoir portion 46 or the liner wall 28 may be replaced by or used in combination with a plurality of small openings (not shown in the drawings) formed in the primary reservoir portion 46 of the liner wall 28. The drainage water is then pumped out of the primary reservoir 60 through discharge pipe 74. Meanwhile, the secondary sump pump 72 in the secondary reservoir 62 remains in a brand-new "out of the box" (or known to be in good) condition as the secondary reservoir 62 is dry. If the primary sump pump 70 fails or breaks down, the drainage water continues to enter the primary reservoir 60. The water level in the primary reservoir 60 rises until it reaches the top of the weir 50, at which point the drainage water spills over the weir 50 and into the secondary reservoir 62, where it may activate a water-sensitive alarm 202 positioned in the secondary reservoir 62.

It is noted at this point that in another embodiment, the weir 50A may be embodied such that it has a generally inverted V-shaped cross section. This is shown in FIG. 1A. Such an inverted V-shape allows for the convenient stacking, packing, and shipping of the liners 20, as the liners may be nested in one another.

The water level rises in the secondary reservoir 62 and continues to rise until it activates the secondary sump pump 72, at which point the secondary sump pump 72 pumps the drainage water through its discharge pipe 76 and the drainage water exits the sump liner 20. The sump liner 20 advantageously allows for a secondary sump pump 72 in "out of the box" condition (or known to be in good working order) to start pumping whenever it is called upon. Thus, the sump liner 20 is a superior advance in that its configuration guarantees that a dry secondary sump pump 72, safely stowed in an out of the way location, is already connected to discharge piping, is energized, and is immediately available to start pumping drainage water from the sump liner.

Figure 1:
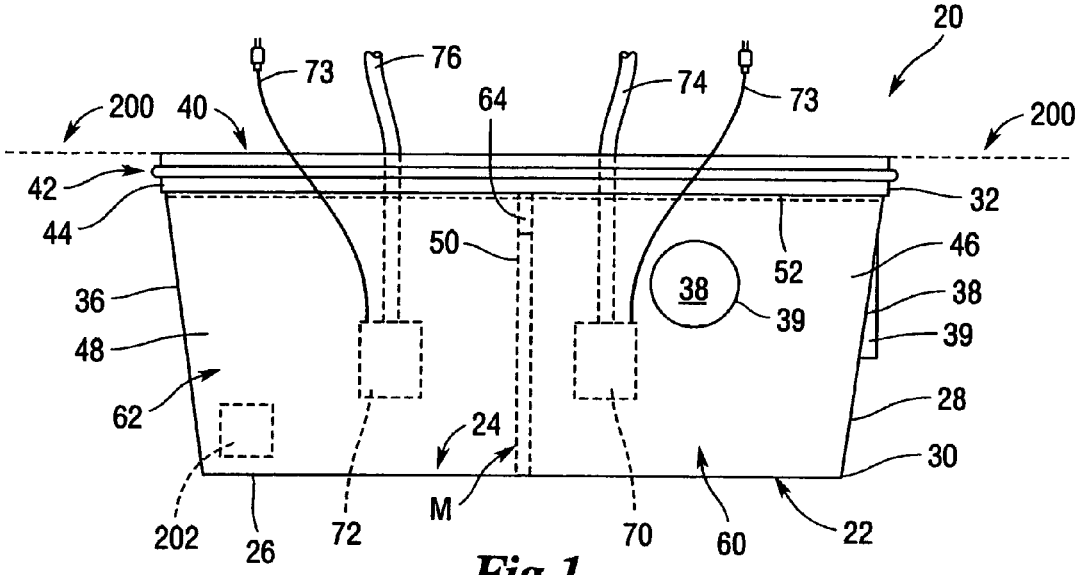
FIG. 1 is a frontal side elevational view of the sump liner.
Figure 1A:
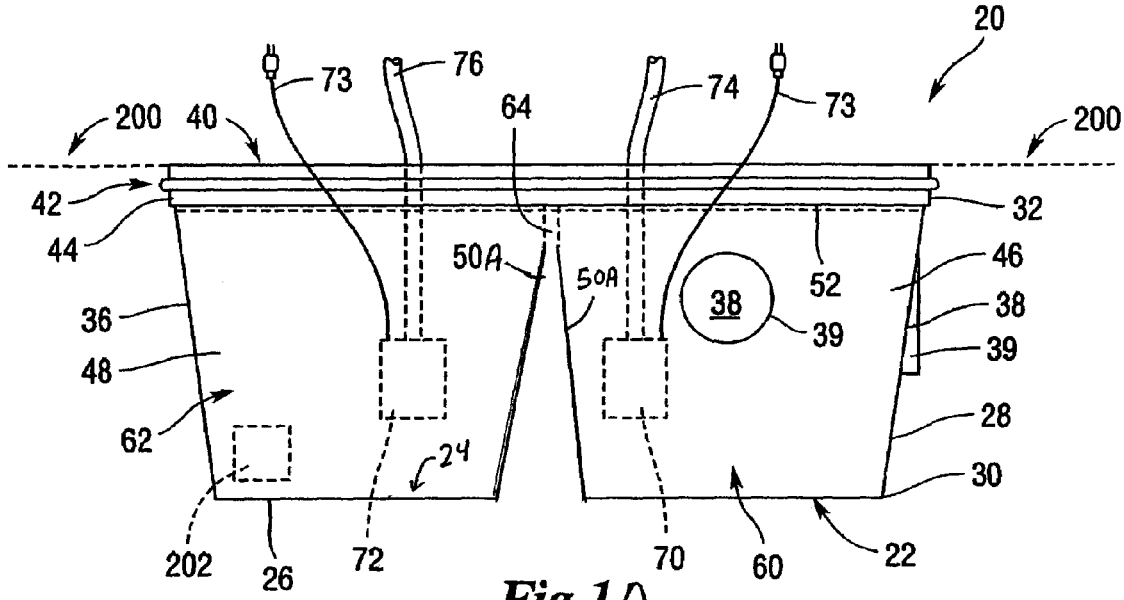
FIG. 1A shows a frontal side elevational view of the sump liner which shows the inverted V-shaped weir.

Turning to the sump liner 20 shown in the side elevational view of FIG. 1, the sump liner 20 comprises a base member 22 comprising a top side 24 and a bottom side 26. As shown in the top plan view of FIG. 3 the base member 22 comprises an elongated elliptical shape. The sump liner 20 further comprises a liner wall 28 which comprises a proximal end 30 and distal end 32. The proximal end 30 of the liner wall 28 comprises an elongated elliptical shape and comprises a length designated D1 and a width designated D3, as shown in FIG. 3. The proximal end 30 of the liner wall 28 is joined with the top side 24 of the base member 22. The distal end 32 of the liner wall 28 also comprises an elongated elliptical shape and comprises a length designated D2 and a width designated D4, as shown in FIG. 3. The liner wall 28 also comprises a primary reservoir portion 46 and a secondary reservoir portion 48. Thus, the primary reservoir 60 is bounded by the base member 22, the primary reservoir portion 46 of the liner wall 28, and the weir 50; and the secondary reservoir 62 is bounded by the base member 22, the secondary reservoir portion 48 of the liner wall 28, and the weir 50. Additionally, the secondary reservoir portion 48 of the liner wall 28 is impermeable so groundwater does not seep therethrough and enter the secondary reservoir 62 in that manner. This ensures the secondary reservoir 62 stays dewatered until water flows over the weir 50.

Figure 2:
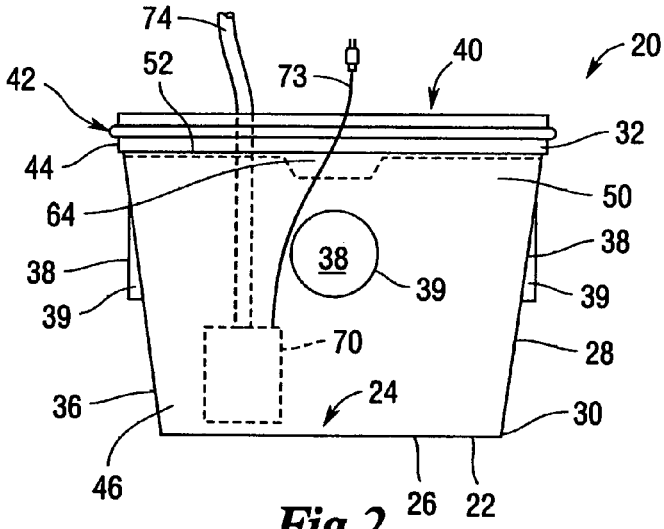
FIG. 2 is an end elevational view of the sump liner.

As shown in FIGS. 1 and 2, D2 is greater than D1, and D4 is greater than D3, so that the liner wall 28 takes on a truncated conical shape. Alternatively, D3 and D4 may be equal to one another and D1 and D2 may be equal to one another in which case the liner wall 28 takes on an oblong cylindrical shape. In other embodiments, the liner wall may comprise a cylindrical shape.

Figure 7:
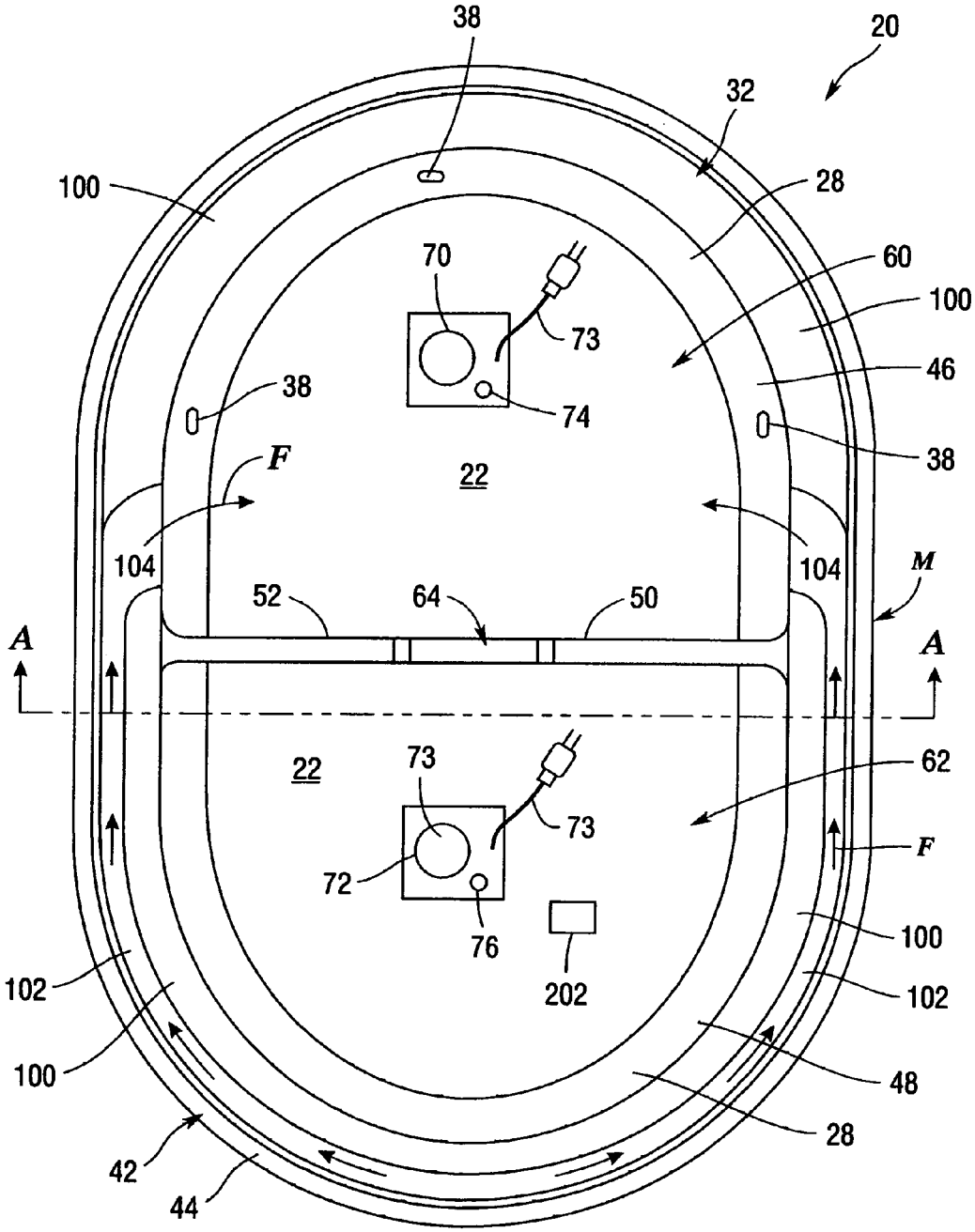
FIG. 7 is an expanded top plan view of the sump liner of FIG. 3 showing the lid support surface and gutter in greater detail (no lid on sump liner).
Figure 8:
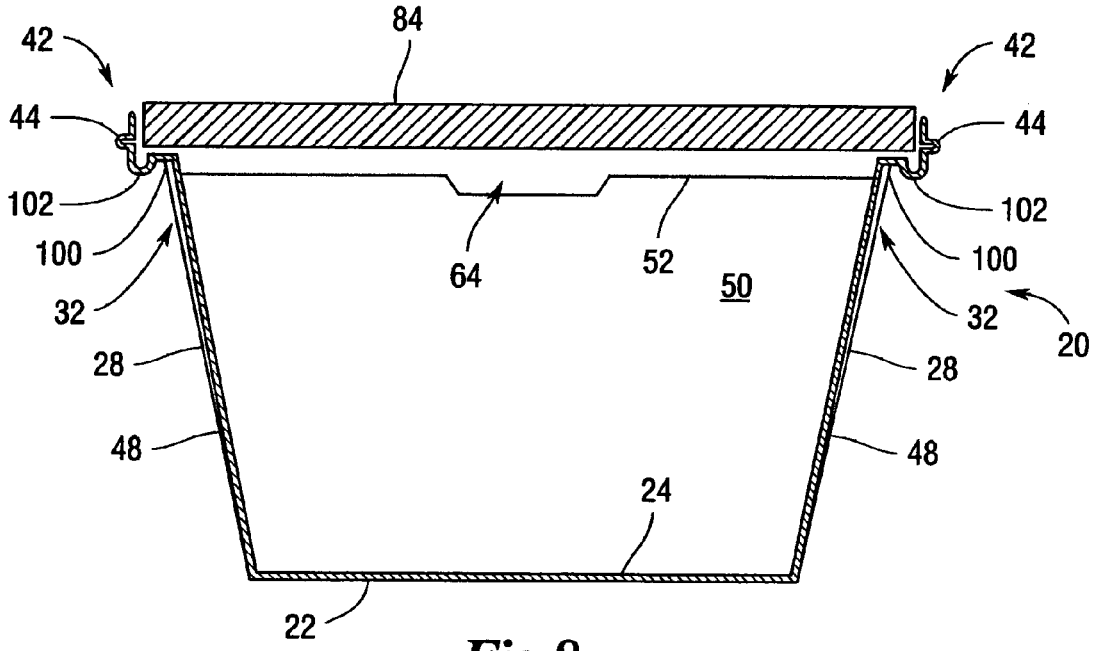
FIG. 8 is a side elevational sectional view of the sump liner and lid taken along cut line A—A of FIG. 7 (lid shown for illustrative purposes).

The liner wall 28 further comprises an inside surface 34 and an outside surface 36. Inlet pipes 39 extend through cutouts 38 defined in the primary reservoir portion 46 of the liner wall 28 which allow drainage water to pass therethrough and enter the sump liner's 20 primary reservoir 60. In other embodiments, the primary reservoir portion 46 of the liner wall may define perforations (not shown) alone or in combination with the inlet pipes 39 allowing water to enter the primary reservoir 60. The secondary reservoir portion 48 of the liner wall 28 is impermeable so that surrounding groundwater does not seep therein. This keeps the secondary reservoir 62 dry so that the secondary reservoir 62 fills only with water that flows over the weir 50. Also, in the vicinity of the distal end 32 of the liner wall 28 is a means for keying and/or securing 42 the sump liner 20 to the basement floor 200 which, as shown in FIGS. 1, 7–8, comprises a protruding lip 44 that extends about the periphery of the sump liner's 20 outside surface 36. The means for keying 42 prevents hydraulic forces generated by surrounding ground water from lifting the sump liner 20 above the basement floor 200.

Figure 4:
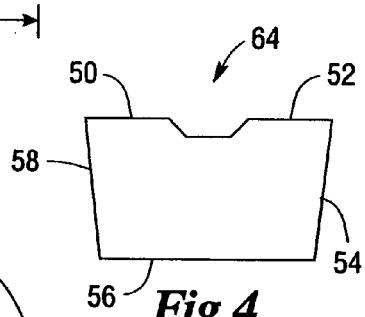
FIG. 4 is a side elevational view of the weir.

The dam or weir 50 comprises a first side 52, a second side 54, a third side 56, and a fourth side 58 and is sized so as to be receivable in the sump liner 20 interior 40. The weir 50 makes contact with the inside surface 34 of the sump liner 20, as shown in FIGS. 3 and 4. Also, the weir 50 extends from the base member 22 and the inside surface of the liner wall 34 at the location designated M in FIGS. 1 and 3. Location M is where the primary reservoir portion 46 of the liner wall 28 and the secondary reservoir portion 48 of the liner wall 28 meet and may serve as a midpoint of the sump liner 20. The weir 50 thus divides the liner interior 40 into the primary reservoir 60 and secondary reservoir 62. If the sump liner 20 is formed as a unitary body, then the weir 50 merges with the inside surface 34 of the liner wall 28, that is, the second side 54, third side 56, and fourth 58 side of the weir 50 are joined with the inside surface 34 of the liner wall 28. The weir 50 extends from the base member 22 to substantially the distal end 32 of the liner wall 28. The first side 52 of the weir 50 also defines a spill-way 64, the utility of which is to be described presently. Alternatively, the weir may be embodied such that the first side 52 is recessed with respect to the distal end 32 of the liner wall 28 in which scenario the spill-way 64 is optional. A water sensitive alarm 202 may be provided which is positionable in the secondary reservoir 62.

A primary sump pump 70 is provided for in the primary reservoir 60 and a secondary sump pump 72 is provided for in the secondary reservoir 62. The primary and secondary sump pumps 70,72 may be identical standard electric sump pumps each comprising a switch, a motor, a pump, and a float (not shown in drawings). When the water level rises the float moves upwardly, closes the switch, and activates the motor. This activates the primary sump pump 70 or secondary sump pump 72, as the case may be. It is noted that the primary sump pump 70 and secondary sump pump 72 may comprise internal check valves so that water does not backflow down the discharge pipes 74, 76 respectively and back into the sump liner 20.

Figure 5:
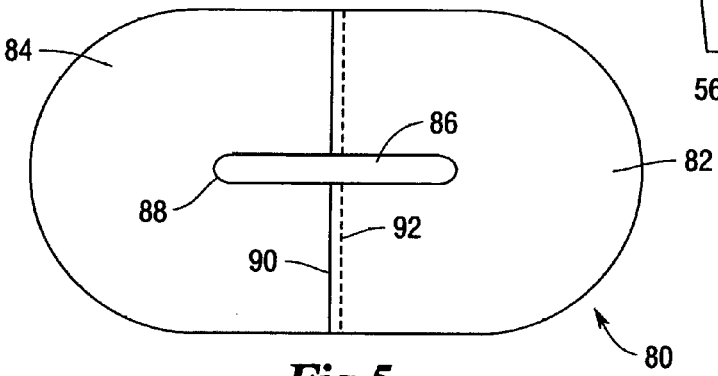
FIG. 5 is a top plan view of the lid.
Figure 6:
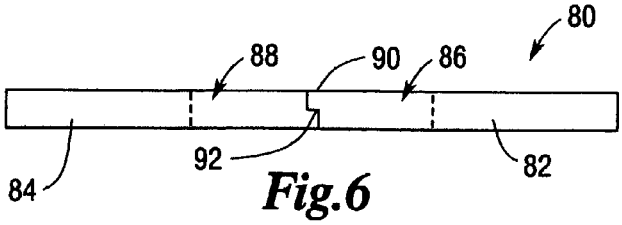
FIG. 6 is a side elevational view of the lid.

A lid 80 is provided for, sized so as to be fittable over the sump liner's 20 primary reservoir 60 and secondary reservoir 62, the lid 80 being shown in FIGS. 5 and 6. The lid 80 comprises a primary half 82 for covering the primary reservoir 60 and a secondary half 84 for covering the secondary reservoir 62. The primary and secondary lid halves 82, 84 may be such that the primary half 82 has a lip 90 which rests on a protrusion 92 extending from the secondary half 84, as seen in FIG. 6. The primary lid half 82 defines a primary lid opening 86 and secondary lid half 84 defines a secondary lid opening 88, these primary and secondary lid openings 86, 88 allowing discharge pipes 74, 76 to pass therethrough, as shown in FIGS. 1, and 5–6. In other embodiments, the weir 50 may be embodied so as to be sufficiently wide so that the primary lid half 82 and secondary lid half 84 comprise abutting flat faces (the lip 90 and protrusion 92 are absent) and both rest on the first side 52 of the weir 50 with the weir 50 providing support. This embodiment is not shown in the drawings.

The distal end 32 of the liner wall 28 comprises a surrounding support surface 100 which supports the lid 80 when the lid 80 is placed thereon. The support surface 100 is shown in FIGS. 3 and 7–8, FIG. 7 showing an enlarged top plan view of FIG. 3. FIG. 8 shows a side elevational sectional view of the sump liner 20 along cut line A—A of FIG. 7. It is noted that FIG. 8 also shows a sectional view of the secondary half 84 of the lid 80 for purposes of illustration, that is, to show how the lid 80 is supported by the support surface 100.

As shown in FIG. 7, the support surface 100 extends about the periphery of the distal end 32 of the liner wall 28. The support surface 100 defines a gutter 102 about the periphery of the secondary reservoir portion 48 of the liner wall 28 (FIG. 7). The gutter 102 not only surrounds the secondary reservoir portion 48, but it extends past the weir 50 and past the midpoint designated M, as seen in FIG. 7. The gutter 102 then leads to a gutter outlet 104 which allows flow from the gutter to enter into the primary reservoir portion 46, as shown in FIGS. 3 and 7. The gutter 102 collects and moves water which flows into it from the surrounding floor 200 In particular, the water in the gutter 102 flows in the direction of the arrows, indicated by the reference letter F, through the gutter 102 and out the gutter outlet 104 spilling into the primary reservoir 60. The gutter 102 keeps water out of the secondary reservoir 62 by directing any water that enters it to flow into the primary reservoir 60. The gutter 102 thus keeps the secondary reservoir dry 62.

Figure 9:
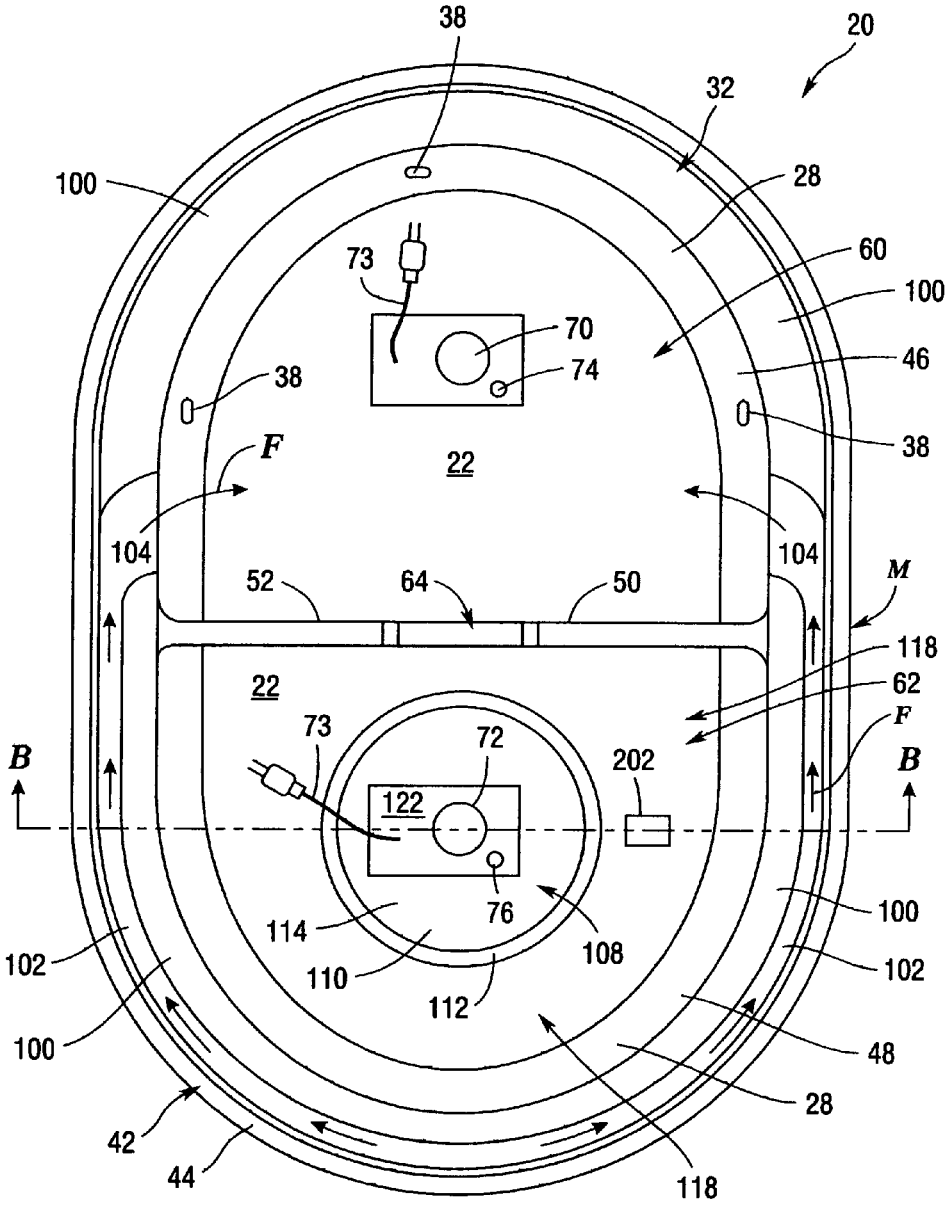
FIG. 9 is a top plan view of a second embodiment of the sump liner (no lid).
Figure 10:
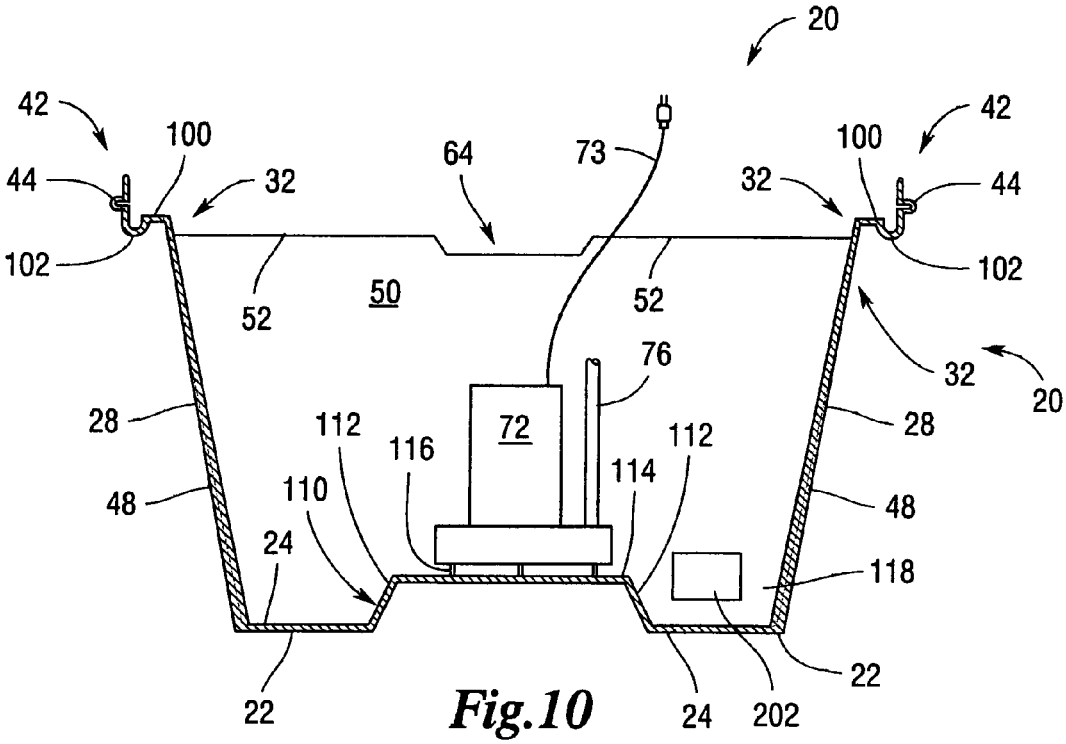
FIG. 10 is a side elevational sectional view of the second embodiment of the sump liner taken along cut line B—B of FIG. 9.

In a second embodiment of the sump liner 20, shown in FIGS. 9 and 10, there is provided a means for elevating 108 the secondary pump 72 in the secondary reservoir 62, useful in situations wherein the gutter 102 is overloaded with incoming water. FIG. 9 shows a top plan view of this embodiment, and FIG. 10 shows a side elevational sectional view of this embodiment taken along cut line B—B of FIG. 9. Turning to FIG. 9, the elevation means 108 comprises a base member 22 comprising a riser 110, the riser 110 comprising a riser wall 112 which supports the elevated platform 114. The secondary sump pump 72 is supported by legs 116 (FIG. 10) and is placed on the elevated platform 114. The elevated platform 114 allows for a surrounding water basin 118 to be defined in the secondary reservoir 62, shown in FIG. 10. In particular, the water basin 118 is defined between the elevated platform's riser wall 112, the weir 50, the surrounding secondary reservoir portion 48 of the liner wall 28, and the top side 24 of the base member 22.

The water basin 118 is a superior design, as it advantageously allows for the secondary pump 72 to remain elevated above any water which seeps into the secondary reservoir 62. Water may seep into the secondary reservoir if the gutter 102 is overloaded with drainage water from the surrounding floor 200, or if the gutter outlet 104 is overloaded. The elevated platform 114 keeps the secondary pump 72 above this seepage water. Further this seepage water will collect in the water basin 118 and activate the alarm 202. Thus, the water basin 118 keeps the secondary pump 72 in "out of the box" condition even if small amounts of water seep into the secondary reservoir 62. Of course, if mass quantities flow into the secondary reservoir 62 in the event of primary pump 70 failure or overload, the secondary pump 72 will commence pumping as soon as the surrounding water level rises high enough to activate the pump 72. Thus, one of the advantages of the water basin 118 is that in the event of small seepages of water in to the secondary reservoir 62, the secondary pump 72 will not be exposed to the deleterious effects of this water, meaning the secondary pump 72 remains in a pristine condition for future use. Yet another advantage of the second embodiment of the sump liner 20 is that the previously described lid 80 may be readily positioned on it. Another advantage is that the means for elevating 108 are shaped so as to allow for the stacking of the sump liners 20. This results in facilitated transportation and storage of the sump liners 20. Such stacking of the sump liners may similarly be done in the first embodiment.

Installation and Operation

To install the sump liner 20 a hole of sufficient size is made in the concrete basement floor 200 and the sump liner 20 is inserted therein such that it is substantially flush with the basement floor 200. Next mortar and/or concrete are filled in around the sump liner 20 and the means for keying 42 which secures the sump liner 20 to the basement floor 200. If the building is being constructed the sump liner 20 may be inserted into a defined sump hole prior to pouring the concrete basement floor 200, in which case the concrete could be poured around an already positioned sump liner 20 and means for keying 42. This obviates the need for making a hole in the basement floor 200. In any event, the sump liner 20 is positioned in the hole and fixed therein by way of pouring concrete/mortar around the sump liner 20 and leveling the concrete/mortar substantially flush with distal end 32 of the liner wall 28. The sump liner 20 is thus fixed to the basement floor 200 so that it is immovable by hydraulic forces imposed by ground water.

In use, drainage water flows through the inlet pipes 39 (and/or perforations) that pass through the liner wall 28 and from there into the primary reservoir 60. Drainage water from the gutter 102 will also flow into the primary reservoir 60 through the gutter outlet 104. When the water level rises sufficiently, the primary sump pump 70 activates and pumps the drainage water out of the sump liner 20 through discharge pipe 74 and out to a desired location such as a field or sewer. In the event of a failure of the primary sump pump 70, that is the primary sump pump 70 can no longer remove incoming water quickly enough or cannot remove incoming water at all, the water level rises in the primary reservoir 60. The water level continues to rise until it flows over the weir 50 moving through the spill-way 64. In other embodiments of the weir 50 wherein the first side 52 of the weir 50 is recessed with respect to the distal end 32 of the liner wall 20 and no spill-way 64 is provided for, the water simply flows over the first side 52 of the weir 50.

Once the drainage water flows over the weir 50, it fills the previously dry secondary reservoir 62 with water. A water-activated alarm 202 which may be present in the secondary reservoir 62 activates upon contact with the drainage water alerting the building owner of primary sump pump 70 failure. Then, when the water level is sufficiently high, the secondary pump 72, which is in "out of the box" new condition (or known to be in good working order), pumps the water through its discharge pipe 76 and out of the sump liner 20. The building owner is thus protected against primary sump pump 70 failure in a most reliable manner, because the secondary sump pump 72, preserved pristine condition in the secondary reservoir 62, is already connected to discharge plumbing, is energized and is immediately ready to pump. Additionally, the secondary sump pump 72 may be battery-powered or powered by the building's electrical system, or powered from the buildings municipal water connection.

The operation of the second embodiment which comprises the means for elevating 108 is described above.

The building owner saves time, money, and an untold amount of grief, as the sump liner 20 provides for a secondary reservoir 62 for stowing a clean, new, and reliable secondary sump pump 72. The present sump liner 20 is thus a superior advance over past sump liners in which one or more pumps are tightly packed and could interfere with one another and wherein the backup pumps in the sump are constantly exposed to the deleterious effects of long-term immersion in water such that they may malfunction when called upon to pump. The present sump liner is also superior to the past attempts at providing a backup sump pump because the secondary sump pump 72 is safely stowed in a dry and clean environment in the secondary reservoir 62 and is readily accessible for inspection and/or replacement by merely lifting the secondary lid half 84. The present sump liner 20 is also beneficial to the building owner's state of mind because the building owner knows that a brand new "out of the box" (or known to be in good working order) secondary sump pump 72 is always ready to start pumping drainage thereof. Furthermore, the sump liner 20 may be a molded unitary body, and the primary and secondary water.

Figure 11:
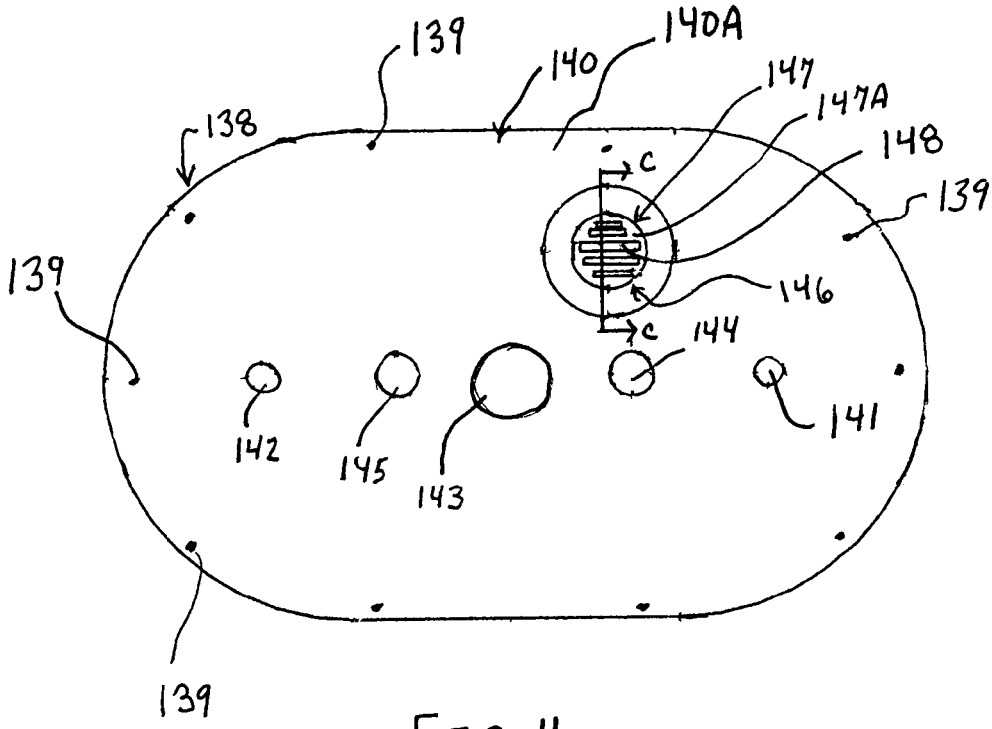
FIG. 11 is a top plan view of another embodiment which shows the vented lid.
Figure 12:
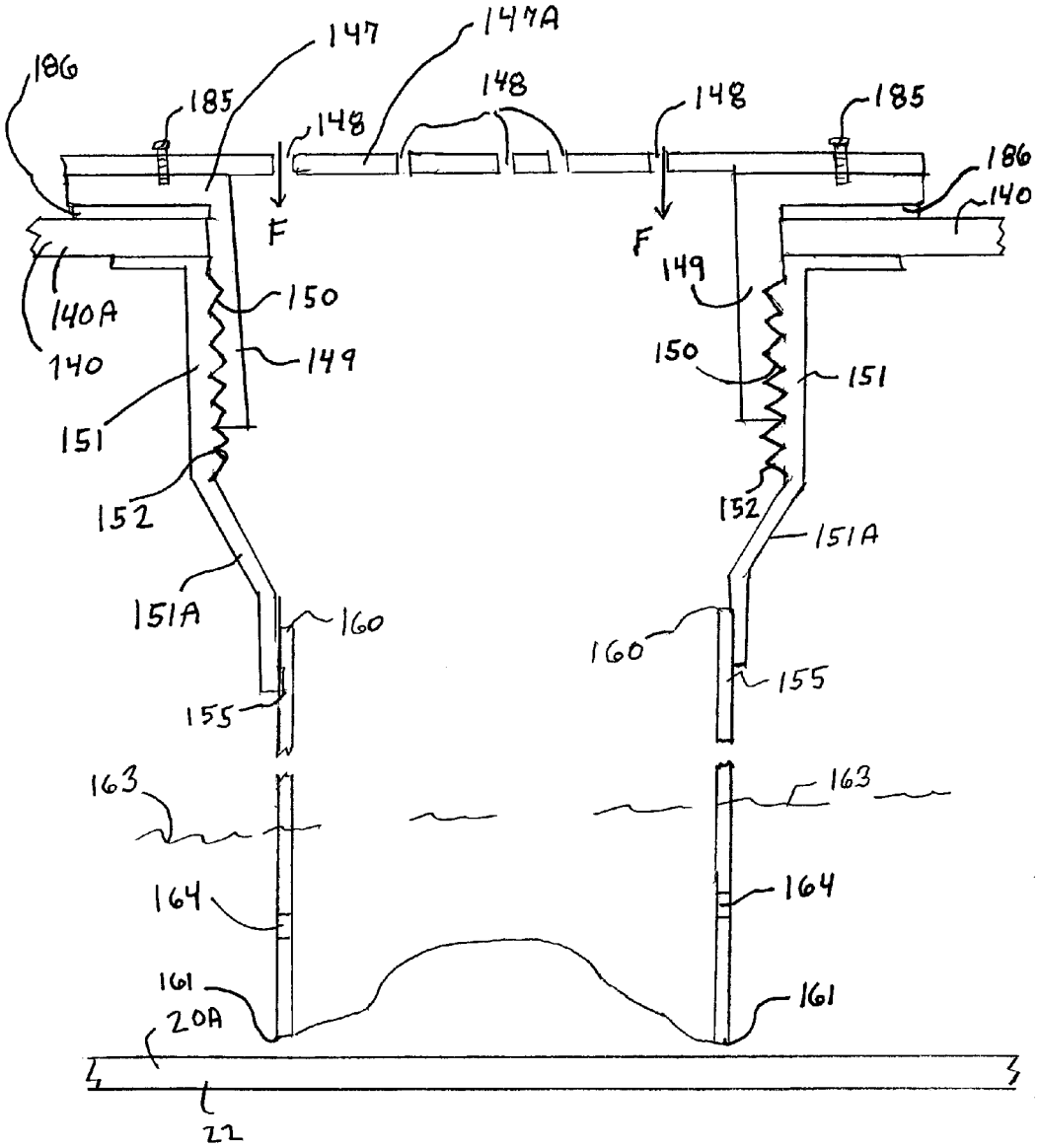
FIG. 12 is a partial sectional view of the of the drain taken along cut line C—C.
Figure 13:
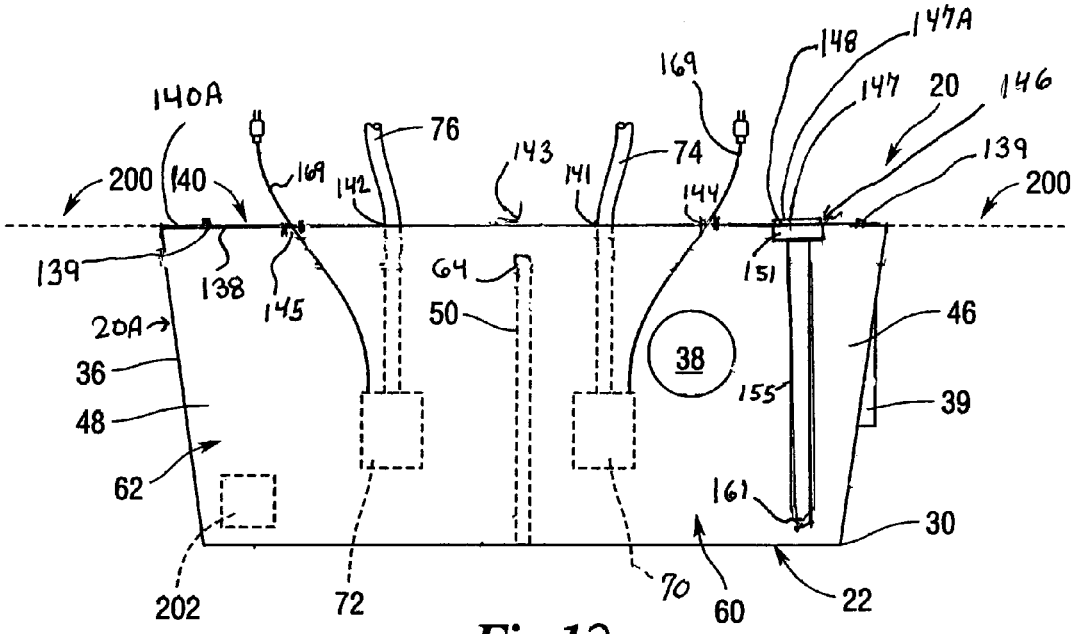
FIG. 13 is a frontal side elevational view of the sump liner and vented lid.

A third embodiment of the invention is shown in FIGS. 11–13. FIG. 11 shows a top plan view of the vented lid 140. The vented lid 140 comprises a body 140A. The vented lid 140 is used with sump liner 20A (FIG. 13). When the vented lid 140 and sump liner 20A are brought together as shown in FIG. 13, water cannot flow between the sump liner 20A and the vented lid 140. This is due to the fact that the vented lid 140 is bolted by bolts 139 to the sump liner 20A. A gasket 138 is provided between the sump liner 20A and vented lid 140, such that when the bolts 139 are tightened, an airtight seal is formed between the vented lid 140 and sump liner 20A. Then, water from inside the building, that is the building basement, may only enter the sump liner 20A through the drain 147 to be described presently. As shown, the vented lid 140 has a primary pump discharge opening 141 and a secondary pump discharge opening 142. The vented lid 140 also has a vent opening 143 that leads from the interior to the exterior of the sump liner 20A. The vented lid 140 also has a primary electrical cable opening 144 and a secondary electrical cable opening 145. The vented lid 140 may be embodied as a unitary body as shown.

Additionally, the vented lid 140 has a drain opening 146. A drain 147 having a drain plate 147A that has openings 148 is received in the drain opening 146, as shown in FIG. 11. Drainage flows through the drain openings 148 as indicated by arrows F. FIG. 12 shows a partial sectional view of the vented lid 140 and drain 147 and sump liner 20A. The drain 147 has a threaded portion 149 with external threads 150. The threaded portion 149 is threaded into a drain pipe support member 151 which has internal threads 152. To attach the drain 147 to the vented lid 140, a gasket 186 is placed around the drain opening 146. Then the drain 147 is moved through the drain opening 146. Next, the external threads 150 and internal threads 152 are threaded together, and upon tightening, the drain 147 is secured to the vented lid 140. The drain pipe support member 151 is thus supported by the vented lid 140. The drain plate 147A is attached to the drain 147 by screws 185 or other means for securing. The gasket 186 is captured between the vented lid 140 and drain plate 147A. Of course, in other embodiments, the vented lid 140 may be configured such that the drain plate 147A is substantially flush with the vented lid 140, or depressed with respect to the drain plate.

A drain pipe 155 is provided that is attached to/connected to the support member 151. The drain pipe 155 has a connected end 160 which connects to the support member 151 and a submerged end 161. In an embodiment, the drain pipe support member 151 may have a conical portion 151A so that a drain pipe 155 having about a 2 (two) inch diameter can be inserted there, as shown in FIG. 12. Of course, the drain pipe 155 may be otherwise dimensioned in other embodiments.

In FIG. 12 the water line of the water in the sump liner 20 is indicated by reference number 163. The submerged end 161 of the drain pipe 155 is used to provide the seal such that air/gas/radon gas inside the sump liner 20A cannot escape out of the sump liner 20A and into the basement/building's atmosphere. In particular, the submerged end 161 has openings 164, or is shaped as shown in FIG. 12 so that only portions of the submerged end 161 of the drain pipe 155 contact the sump liner 20A. In any event, the drain pipe 155 does not form a seal with the sump liner 20A. This allows the free flow of water from the building's floor, through the drain 147, through the drain pipe 155 and into the liner 20 where it is pumped out by the primary sump pump 70. As the water is pumped out of the liner 20A, its level will drop, or remain the same, but air/gas/radon gas in the sump liner 20A above the water line 163 cannot flow out of the drain 147, because of the water in the drain pipe 155. Rather, all air being vented flows through the vent opening 143 and out of the house through vent pipes (not shown).

FIG. 13 shows a side elevational view showing the vented lid 140 locked down on a sump liner 20A. Of course, in other embodiments the vented lid 140 may be used with the sump liners 20 having the inverted V-shaped weirs 50A. Also, the electrical cables 169 run to the primary and secondary pumps 70, 72, respectively.

It is noted that in this embodiment, airtight seals are formed where the electrical cables 169 pass through the vented lid 140, and the drain pipes 74, 76 pass through the vented lid 140. Additionally, exhaust sump gas is piped to a location outside the house or building.

The present vented lid 140 also allows testing of, for example the primary sump pump 70, without having to open the lid. The user need only pour water into the drain 147 and visually inspect to see if the water level in the pipe 155 is lowering. This will be an indication the pump 70 is functioning properly. Thus, this testing methodology is useful because the person inspecting the sump pump 70 is not exposed to radon from inside the sump liner 20A, since the vented lid does not need to be removed in order to do the inspection.

The sump liner 20 and lid 80 may be manufactured from the following materials comprising: plastics, thermoformed plastics, injection molded plastics, metals, ceramics, and combinations lid halves 82, 84 may also be a molded as unitary bodies. The structure of the liners 20, weirs 50A, lids 80, and vented lids 140 allows for the stackability and thus easy transport of the sump liners 20. Additionally, because the sump liner 20 and lid 80 may be cast in molds and because of economies of scale both the sump liner 20 and lid 80 may be quickly mass produced at low production cost.

It is to be understood that various changes in the details, parts, materials, steps, and arrangements, that have been described and illustrated herein in order to describe the nature of the sump liner, may be made by those skilled in the art within the principles and scope of the present sump liner. While embodiments of the sump liner are described, that is for illustration, not limitation.

What is claimed:

1. A sump liner comprising:

a) a base member;

b) a liner wall comprising a proximal end and a distal end, the proximal end joined with the base member;

c) the liner wall joined with and extending about the periphery of the base member, the liner wall and the base member defining a sump liner interior therein;

d) the liner wall comprising an inside surface and an outside surface;

e) a weir, the weir positioned in the sump liner interior, the weir comprising an inverted V-shape and divides the sump liner interior into a primary reservoir and an adjacent secondary reservoir; and f) wherein the liner wall further comprises a primary reservoir portion and an impermeable secondary reservoir portion, the primary reservoir portion of the liner wall defining a cutout for allowing groundwater to flow through and enter the primary reservoir, the weir for controlling the flow of water into the secondary reservoir.

2. An apparatus for protection against radon gas, the apparatus comprising:

a) a sump liner, b) a vented lid having a vent opening and a drain opening for the passage of external water into the sump liner, c) the sump liner connected to the vented lid to form an airtight seal between the sump liner and the vented lid, and d) a drain positioned in the drain opening and a drain pipe support member joined to the drain such that the drain forms a seal with the vented lid and a drain pipe extending from the drain pipe support member for being at least partially submerged in water in the sump liner so that radon gas from inside the sump liner cannot exit the sump liner through the drain.

3. The apparatus according to claim 2 wherein the drain has an external thread and the drain pipe support member has an internal thread such that when the external thread and the internal thread are threaded to one another and tightened the drain is supported by the vented lid and the drain support member is supported by the drain.

4. The apparatus according to claim 2 wherein the vented lid further comprises a primary pump discharge opening and a secondary pump discharge opening, and wherein the vent opening is for allowing gas to exit the sump liner.

5. The apparatus according to claim 2 wherein the seal includes a gasket positioned around the drain opening in the vented lid and located between the drain and the vented lid.

6. The apparatus according to claim 2 wherein the sump liner has a base and a liner wall that are joined to form a sump liner interior, and the sump liner has a weir that divides the sump liner interior into a primary reservoir and a secondary reservoir and wherein the drain pipe extends into the primary reservoir and the weir is for controlling the flow of water from the primary reservoir into the secondary reservoir.

7. A method of controlling radon gas comprising:

a) providing a sump liner, b) providing a vented lid having a vent opening and a drain opening, c) joining the sump liner and the vented lid to form an airtight seal between the sump liner and the vented lid, d) positioning a drain in the drain opening and joining a drain pipe support member to the drain such that the drain forms an airtight seal with the vented lid, and e) joining a drain pipe to the drain pipe support member and allowing the sump liner to partially fill with water such that the drain pipe is at least partially submerged in the water to form a seal therewith such that radon gas inside the sump liner cannot escape through the drain pipe.

8. The method of claim 7 further comprising providing the drain with an external thread and providing the drain pipe support member with an internal thread and threading the drain and drain pipe support member together such that the drain is supported by the vented lid and the drain support member is supported by the drain.

9. The method of claim 7 further comprising providing the vented lid with a primary pump discharge opening and a secondary pump discharge opening, and wherein the vent opening is for allowing radon gas to exit the sump liner.

10. The method of claim 7 further comprising providing a gasket and positioning the gasket between the drain and the vented lid prior to joining the drain and the drain support member for forming an airtight seal between the vented lid and the drain.

11. The method of claim 7 further comprising providing the sump liner with a base and a liner wall and joining the base and liner wall to form a sump liner interior, and providing the sump liner with a weir that divides the sump liner interior into a primary reservoir and a secondary reservoir such that the drain pipe extends into the primary reservoir.

12. The method of claim 7 further comprising installing the sump liner in a basement floor.

* * * * *